US006976531B2

(12) United States Patent
Martin et al.

(10) Patent No.: US 6,976,531 B2
(45) Date of Patent: Dec. 20, 2005

(54) HEAT EXCHANGER, METHOD OF FORMING A SLEEVE WHICH MAY BE USED IN THE HEAT EXCHANGER, AND A SLEEVE FORMED BY THE METHOD

(75) Inventors: Michael A. Martin, Oakville (CA); Cindy W. Storr, Burlington (CA); Alan Ka-Ming Wu, Kitchener (CA); Allan K. So, Mississauga (CA); B. Timothy Miller, Burlington (CA); Christina Spirou, Kitchener (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/690,877

(22) Filed: Oct. 22, 2003

(65) Prior Publication Data

US 2005/0087331 A1 Apr. 28, 2005

(51) Int. Cl.[7] ..... F28F 3/02
(52) U.S. Cl. ..... 165/167; 165/78; 165/916
(58) Field of Search ..... 165/167, 78, 916

(56) References Cited

U.S. PATENT DOCUMENTS

| | | | | |
|---|---|---|---|---|
| 1,344,105 A | | 6/1920 | Vance | |
| 2,115,441 A | | 4/1938 | Black | |
| 2,617,634 A | | 11/1952 | Jendrassik | |
| 3,554,150 A | | 1/1971 | Goetschius et al. | |
| 3,661,203 A | | 5/1972 | Mesher | 165/5 |
| 4,470,455 A | | 9/1984 | Sacca | |
| 4,668,443 A | | 5/1987 | Rye | 261/112 |
| 4,696,342 A | | 9/1987 | Yamauchi et al. | |
| 4,742,866 A | | 5/1988 | Yamanaka et al. | |
| 4,781,248 A | * | 11/1988 | Pfeiffer | 165/167 |
| 4,987,955 A | | 1/1991 | Bergqvist et al. | |
| 5,078,209 A | | 1/1992 | Kerkman et al. | |
| 5,088,552 A | | 2/1992 | Raunio | |
| 5,179,999 A | * | 1/1993 | Meekins et al. | 165/167 |
| 5,182,856 A | | 2/1993 | Armbruster | |
| 5,398,751 A | | 3/1995 | Blomgren | |
| 5,538,077 A | * | 7/1996 | So et al. | 165/167 |
| 5,765,632 A | | 6/1998 | Gire | |
| 5,806,584 A | | 9/1998 | Thonon et al. | 165/166 |
| 5,944,094 A | | 8/1999 | Kinney, Jr. et al. | |
| 5,967,227 A | * | 10/1999 | Jensen et al. | 165/78 |
| 5,992,510 A | | 11/1999 | Kallrot | |
| 6,016,865 A | | 1/2000 | Blomgren | |
| 6,167,952 B1 | | 1/2001 | Downing | |
| 6,324,761 B1 | | 12/2001 | Mashiko et al. | |
| 6,601,427 B2 | | 8/2003 | Kondou et al. | |
| 6,615,488 B2 | | 9/2003 | Anders et al. | |
| 2002/0017382 A1 | * | 2/2002 | Nakado et al. | 165/152 |
| 2004/0168793 A1 | * | 9/2004 | Blomgren | 165/167 |

FOREIGN PATENT DOCUMENTS

JP 56-53824 5/1981

* cited by examiner

*Primary Examiner*—Teresa J. Walberg
(74) *Attorney, Agent, or Firm*—Ridout & Maybee LLP

(57) ABSTRACT

A heat exchanger in which a heat exchanger core is disposed within a casing which includes a side wall formed by bending a plate into the form of a sleeve in which edges of the plate are in adjacent, confronting relationship with an inwardly projecting, transversely extending deformation, the deformation being disposed between a pair of press members with one of the press members being transversely inserted within the sleeve. The press members are moved together to remove the deformation with resultant pivoting of the edges into abutting contact or overlapping relationship. The heat exchanger core is formed of a plurality of stacked plate pairs each having a plate in inverted orientation. Outwardly projecting ribs of anticlastic form are so formed in each plate that the ribs on each plate of each plate pair are interengagingly intersect with the ribs on the adjacent plate of the adjacent plate pair accurately to align the plate pairs in the heat exchanger core.

7 Claims, 4 Drawing Sheets

HEAT EXCHANGER, METHOD OF FORMING A SLEEVE WHICH MAY BE USED IN THE HEAT EXCHANGER, AND A SLEEVE FORMED BY THE METHOD

FIELD OF THE INVENTION

This invention according to one aspect relates to a heat exchanger, and according to a further aspect relates to a method of forming a sleeve which is particularly although not exclusively a sleeve intended to be used as a side wall of a casing for a heat exchanger for automotive use.

BACKGROUND OF THE INVENTION

Such a heat exchanger is used as, for example, an oil cooler incorporating a heat exchanger core which comprises a plurality of plate pairs with each plate pair being constituted by two identical plates one of which is disposed in an inverted orientation relative to the other plate of the plate pair. In the heat exchanger core the plate pairs are disposed in stacked relationship, with a space between the plates of each plate pair constituting a flow path for, for example, engine oil between an oil inlet and an oil outlet, and with a space between each adjacent pair of plate pairs constituting a flow path for coolant between a coolant inlet and a coolant outlet. The heat exchanger core is disposed within the casing which may be of rectangular, such as substantially square, form and which comprises top and bottom cover walls mounted on the side wall, one or both of the cover walls having oil inlet and outlet openings in communication, respectively, with the oil inlet to the oil flow path between the plates of each plate pair and with the oil outlet from the oil flow path between the plates of each plate pair. The side wall of the casing has coolant inlet and outlet openings in communication, respectively, with the coolant inlet to the coolant flow path between the adjacent plates of each adjacent plate pair and with the coolant outlet from the coolant flow path between the adjacent plates of each adjacent plate pair.

SUMMARY OF THE INVENTION

According to one aspect of the present invention, there is provided a heat exchanger comprising a plurality of substantially identical heat exchanger plates disposed in stacked relationship, with alternate plates in the stack of plates being in inverted orientation, and with a space between each plate and the plate adjacent thereto. Alternate spaces each constitute a flow path for a first fluid and the remaining spaces constitute a further flow path for a second fluid, each plate having a plurality of ribs each of anticlastic form, whereby the stack of plates includes adjacent plates in which the ribs thereof are in intersecting, interengaged relationship to ensure accurate alignment between said adjacent plates.

According to a further aspect of the present invention, there is provided a method of forming a sleeve comprising the steps of providing a plate of bendable material having a length and a width, with the length of the plate extending between two opposed edges thereof, and bending the plate transversely to form the plate into a sleeve, with said edges in spaced apart, confronting relationship, the plate between said edges thereof being formed with an inwardly projecting, transversely extending deformation. The deformation is disposed between a pair of press members, with one of the press members being transversely inserted within the sleeve, and by relative movement together of the press members the deformation is removed with resultant pivoting of said edges into substantially abutting contact or overlapping relationship. The press members are then separated, and the sleeve is removed.

According to a still further aspect of the present invention, there is provided a sleeve formed by the method according to the invention.

BRIEF DESCRIPTION OF THE DRAWINGS

In order that the invention may be more clearly understood and more readily carried into effect the same will now, by way of example, be more fully described with reference to the accompanying drawings in which.

Figure 2:
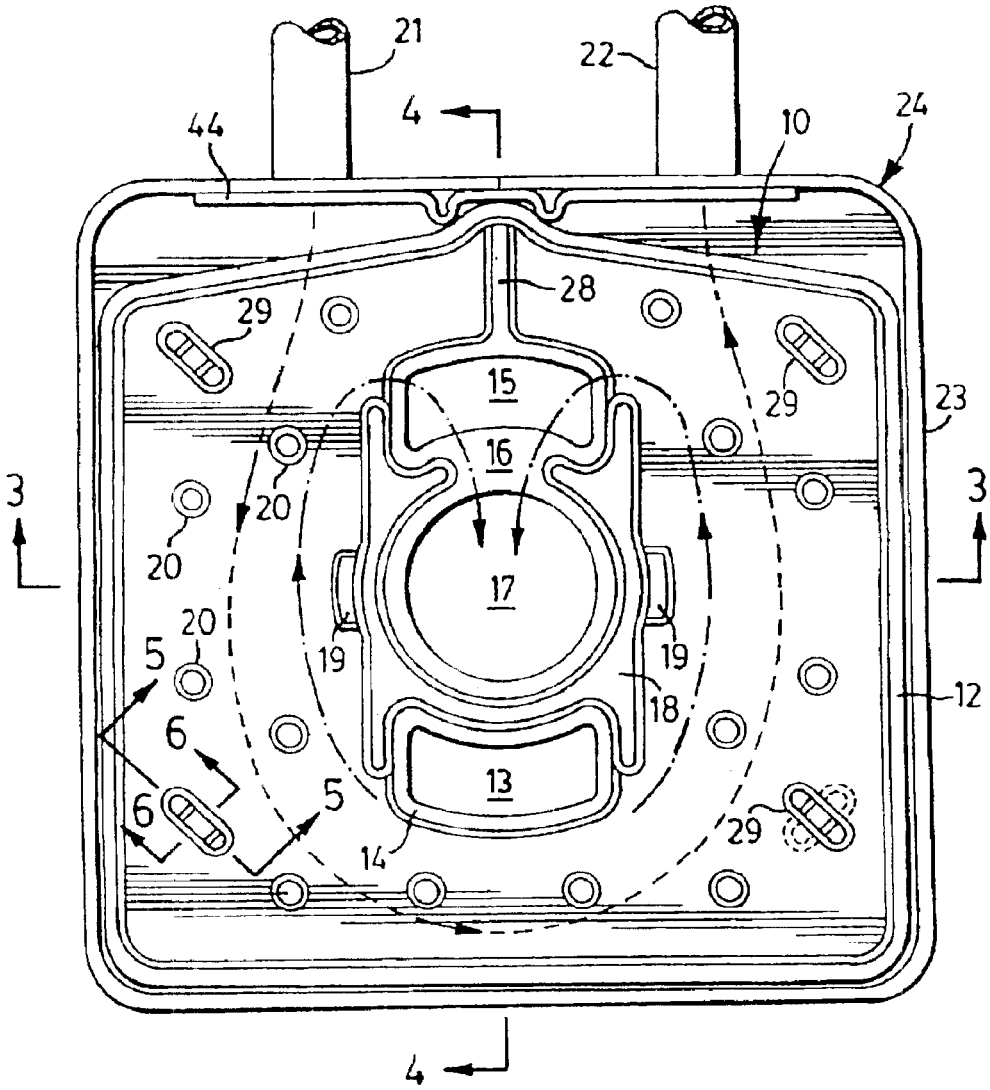
FIG. 2 is a top plan view on an enlarged scale of the heat exchanger shown in FIG. 1, with a top cover wall of the heat exchanger casing removed.
Figure 3:
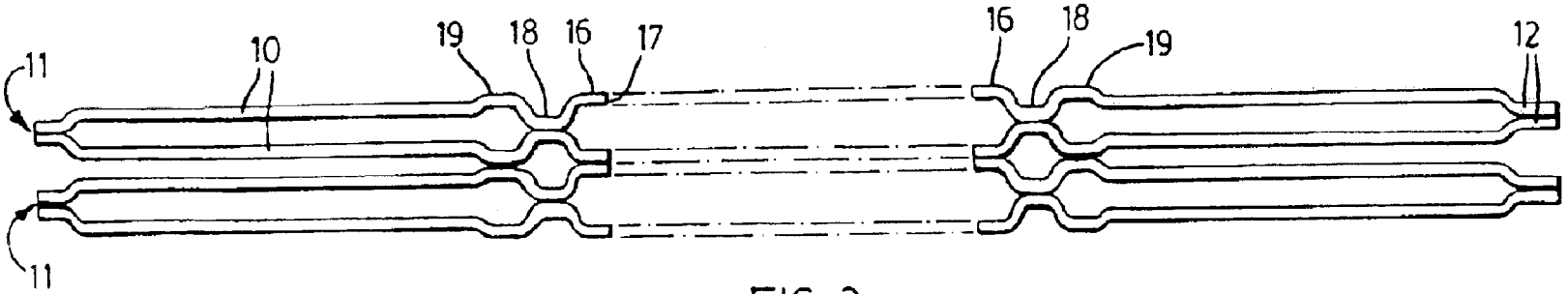
FIG. 3 is a sectioned view on a further enlarged scale and on the line 3—3 in FIG. 2 of the heat exchanger plate shown in FIG. 2.
Figure 4:
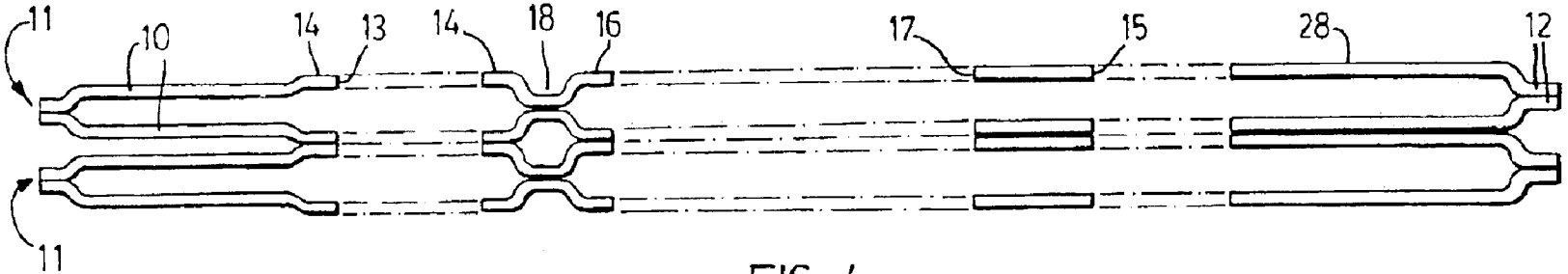
FIG. 4 is a sectioned view on the same enlarged scale as FIG. 3 and on the line 4—4 in FIG. 2 of the heat exchanger plate shown in FIG. 2.
Figure 7:
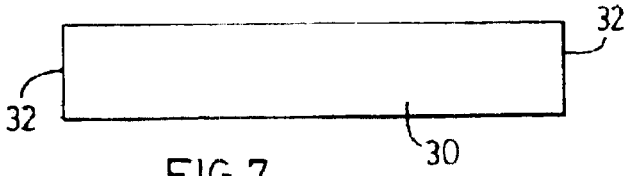
FIGS. 7 to 13, inclusive, show diagrammatically the method according to a preferred embodiment of said further aspect of the invention of forming the side wall of the heat exchanger casing of the heat exchanger shown in FIG. 1.

Referring particularly to FIGS. 2, 3 and 4 of the drawings, 10 denotes generally each of a plurality of heat exchanger plates. The plates 10 are disposed in pairs 11 with one of the plates 10 in each pair 11 thereof being in inverted relationship to the other plate 10 in the pair 11 thereof, a plurality of the plate pairs 11 being in stacked relationship to form a heat exchanger core, although in each of FIGS. 3 and 4 only two such plate pairs 11 in stacked relationship are shown.

Relative to each plate pair 11, each plate 10 thereof has an inwardly disposed peripheral flange 12, an inlet opening 13 for a first fluid such as, for example, engine oil and which is surrounded by an outwardly disposed flange 14, an outlet opening 15 for the engine oil and which is likewise surrounded by an outwardly disposed flange 16 in the same plane as the flange 14, and a central opening 17 which is also provided in the flange 16. 18 represents an inwardly disposed portion of the plate 10 which is in the same plane as the flange 12, and 19 represents each of two outwardly disposed portions which are in the same plane as the flanges 14 and 16. Outwardly disposed dimples 20 which are in the same plane as the flanges 14 and 16 and the portions 19 may be provided in the plate 10, with the dimples 20 which for clarity have been omitted from FIGS. 3 and 4 being so positioned that the dimples 20 in adjacent plates 10 of adjacent plate pairs 11 are in abutting contact, the flanges 14 and 16 and the portions 19 in adjacent plates 10 of adjacent plate pairs 11 likewise being in abutting contact. Furthermore, in each plate pair 11 the flanges 12 and the portions 18 of the plates 10 are also in abutting contact, so that there is a space between the plates 10 of each plate pair 11 constituting a flow path as shown in chain-dotted lines for flow of oil from the inlet opening 13 to the outlet opening 15 and hence to the central opening 17, and between the adjacent plates 10 of adjacent plate pairs 11 there is a space constituting a flow path as shown in dotted lines for flow of a second fluid such as, for example, a coolant from a coolant inlet pipe 21 to a coolant outlet pipe 22, a reinforcement plate 44 being mounted on the inner face of a side wall 23 of a heat exchanger casing 24 within which the heat exchanger core constituted by the stacked plate pairs 11 are disposed, with the inlet pipe 21 and outlet pipe 22 being mounted in the side wall 23 and the reinforcement plate 44. The casing 24 also comprises top and bottom cover walls 25, 26, respectively, in at least one of which is provided an inlet opening (not shown) in communication with the inlet openings 13 in the plates 10, and an outlet opening 27 in communication with the central openings 17 in the plates 10, an outwardly disposed rib 28 which constitutes a continuation of the flange 16 of each plate 10 substantially preventing short-circuiting of coolant directly from the inlet pipe 21 to the outlet pipe 22.

Figure 1:
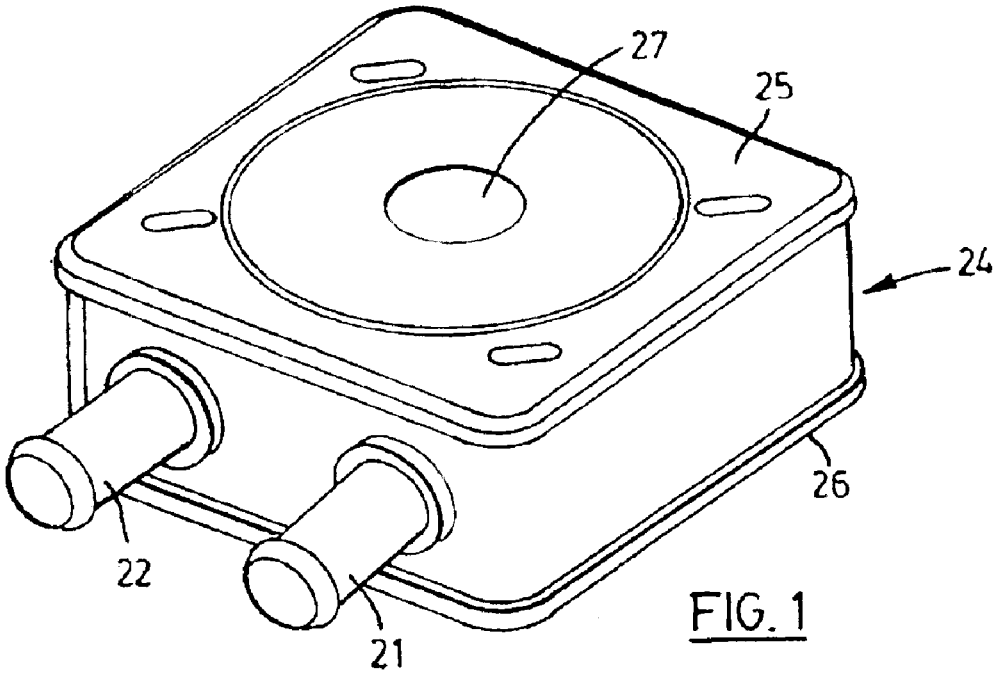
FIG. 1 is an isometric view of a heat exchanger according to a preferred embodiment of said one aspect of the invention and which incorporates a heat exchanger casing having a side wall formed by a method according to a preferred embodiment of said further aspect of the invention.
Figure 5:
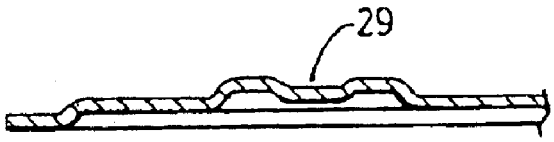
FIG. 5 is a sectioned view on the line 5—5 in FIG. 2.
Figure 6:
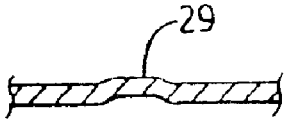
FIG. 6 is a sectioned view on the line 6—6 in FIG. 2.

Each plate 10 of each plate pair 11 has a plurality of inclined ribs 29 which, as more clearly shown in FIGS. 5 and 6, are each of saddle-shaped, i.e., anticlastic form, with the inclined ribs 29 of each plate 10 of each plate pair 11 projecting outwardly from the plate pair 11 and being in intersecting, interengaged relationship with the inclined ribs 29 of the adjacent plate 10 of the adjacent plate pair 11.

Alternatively, or in addition, each plate 10 of each plate pair 11 may have a further plurality of inclined ribs (not shown) which are each of anticlastic form, with these further inclined ribs of each plate 10 of each plate pair 11 projecting inwardly of said plate pair 11 and being in intersecting, interengaged relationship with the further inclined ribs of the other plate 10 of said plate pair 11. The ribs 29 and the further ribs are preferably inclined substantially at 45° so that interengaged ribs intersect at substantially 90°.

Instead of the ribs 29 being inclined, it will be appreciated that, as viewed in FIG. 2, the two left-hand ribs 29 may be vertical or horizontal with the two right-hand ribs 29 being horizontal or vertical, respectively, so that again the ribs 29 of each plate 10 of each plate pair 11 are in intersecting, interengaged relationship with the ribs 29 of the adjacent plate 10 of the adjacent plate pair 11. The further ribs may of course be likewise disposed.

The plates 10 are of aluminum or other heat conducting material provided with a coating of brazing material, so that the plate pairs 11 in stacked relationship as hereinbefore described, may be treated in a brazing furnace to secure the plates 10 together as the heat exchanger core. Alternatively, the heat exchanger casing 24 and the reinforcement plate 44 may also be provided with a coating of brazing material with the plate pairs 11 in stacked relationship disposed within the casing 24 so that the complete heat exchanger may be treated in the brazing furnace.

Figure 11:
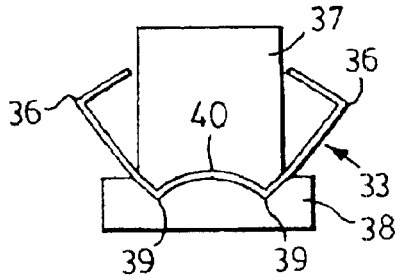
Figure 8:
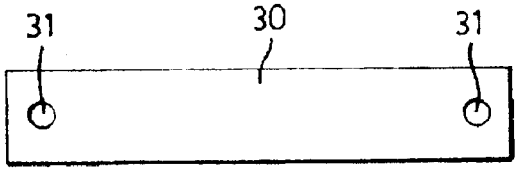
Figure 12:
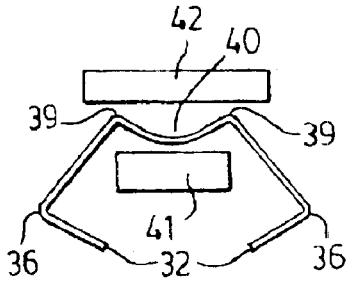
Figure 9:
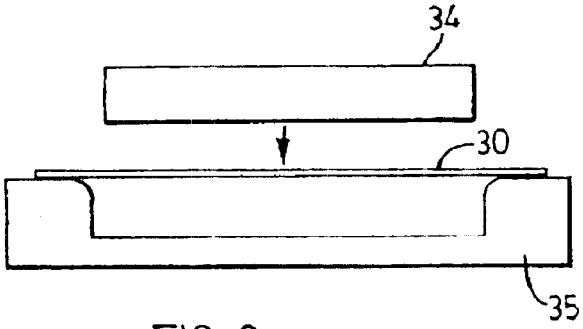
Figure 13:
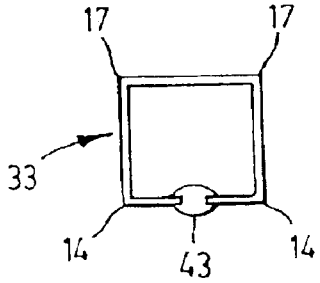
Figure 10:
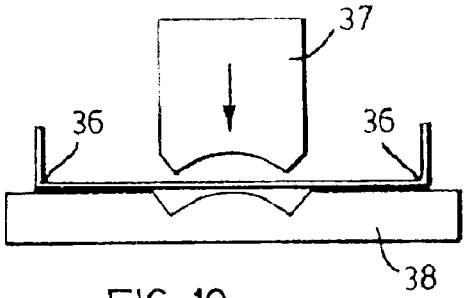

With reference to FIGS. 7 to 13, inclusive, a plate 30 of bendable material such as aluminum is formed with two openings 31 adjacent to edges 32 thereof at the ends of the length of the plate 30, the plate 30 then being formed into a sleeve 33 by bending the plate 30 between a male press member 34 and a female press member 35 (FIG. 9) to form outer corners 36 in the plate 30, and then bending the plate 30 between a male press member 37 and a female press member 38 to form inner corners 39 in the plate 30 together with an inwardly projecting deformation 40 (FIG. 11). This deformation 40 is then disposed between press members 41, 42 with the press member 41 being transversely inserted within the sleeve 33 (FIG. 12), i.e., being inserted into the sleeve 33 perpendicular to the plane of the paper as viewed in FIG. 12. By relative movement together of the press members 41, 42 the deformation 40 is removed with resultant pivoting of the edges 32 into substantially abutting contact (FIG. 13), the edges 32 being thereafter bonded together by, for example, welding 43 thereby to provide the side wall 23 of the heat exchanger casing 24. Alternatively, the edges 32 may be pivoted into overlapped relationship in which case the overlapped portion could be secured together by, for example, crimping. Furthermore, the edges 32 may, if desired, be, for example, angled or V-shaped.

It will be appreciated that, as shown in FIG. 2, the reinforcement plate 44 mates with a bulbous portion of each plate 10 substantially to prevent short-circuiting of coolant directly from the inlet pipe 21 to the outlet pipe 22. Furthermore, the reinforcement plate 44 being secured to the side wall 23 of the casing 24 across the edges 32 assists in maintaining these edges 32 in secure interconnection.

It will be understood that the sleeve 33 may be used as the side wall of a heat exchanger casing in a heat exchanger of a type different from that hereinbefore described with reference to the accompanying drawings, or may be used for other than a side wall of a heat exchanger casing in a heat exchanger, and while as hereinbefore described with reference to the accompanying drawings the sleeve is of rectangular, and more specifically approximately square, shape the sleeve may if desired be of other shapes.

What is claimed is:

1. A heat exchanger comprising a plurality of substantially identical heat exchanger plates disposed in stacked relationship, with alternate plates in the stack of plates being in inverted orientation, and with a space between each plate and the plate adjacent thereof, alternate spaces each constituting a flow path for a first fluid and the remaining spaces constituting a further flow path for a second fluid, and each plate having a plurality of ribs each of anticlastic form, the ribs being located in the spaces constituting one of said flow path and said further flow paths, whereby the stack of plates includes adjacent plates in which the ribs thereof are in intersecting, interengaged relationship to ensure accurate alignment between said adjacent plates.

2. A heat exchanger according to claim 1, wherein the heat exchanger plates comprise a plurality of plate pairs, with the ribs of each plate of each plate pair projecting outwardly from said plate pair and being in interengaged relationship with the ribs of the adjacent plate of the adjacent plate pair.

3. A heat exchanger according to claim 1, wherein the heat exchanger plates comprise a plurality of plate pairs, with the ribs of each plate of each plate pair projecting inwardly of said plate pair and being in interengaged relationship with the ribs of the other plate of said plate pair.

4. A heat exchanger according to claim 2, wherein each plate has a further plurality of ribs each of anticlastic form, with the further ribs of each plate of each plate pair projecting inwardly of said plate pair and being in interengaged relationship with the further ribs of the adjacent plate of the adjacent plate pair.

5. A heat exchanger according to claim 1, further comprising a heat exchanger casing within which the plurality of heat exchanger plates are disposed, a reinforcement plate being mounted within the casing between the heat exchanger plates and a side wall of the casing.

6. A heat exchanger according to claim 5, wherein the reinforcement plate facilitates maintaining securement of the substantially abutting contact or overlapping of edges of the casing side wall.

7. A heat exchanger according to claim 5, wherein the reinforcement plate mates with a bulbous portion presented by each heat exchanger plate substantially to prevent short circuiting of coolant from a coolant inlet in the heat exchanger casing to a coolant outlet in the heat exchanger casing.

* * * * *